United States Patent [19]

Salomon et al.

[11] 4,020,593

[45] May 3, 1977

[54] WINDOW WINDING APPARATUS FOR VERTICALLY DIVIDED AUTOMOBILE SLIDING WINDOW PANES

[75] Inventors: Horst Salomon, Meerholz; Herbert Kouth, Schoneck, both of Germany

[73] Assignee: Rockwell-Golde, GmbH, Frankfurt, Germany

[22] Filed: Feb. 6, 1976

[21] Appl. No.: 655,690

[30] Foreign Application Priority Data

Feb. 24, 1975 Germany ..... 2507893

[52] U.S. Cl. ..... 49/103; 49/352

[51] Int. Cl.[2] ..... E05F 5/12

[58] Field of Search ..... 49/103, 227, 352, 349

[56] References Cited

UNITED STATES PATENTS

| | | | |
|---|---|---|---|
| 3,280,509 | 10/1966 | Werner | 49/352 |
| 3,930,339 | 1/1976 | Jander | 49/352 |
| 3,965,618 | 6/1976 | Pickles | 49/103 |

*Primary Examiner*—Philip C. Kannan

[57] ABSTRACT

A window winding apparatus for a window of a vehicle such as an automobile or the like wherein the window is slidable generally upwardly-downwardly in an opening or closing action and is divided approximately vertically into a viewing pane and a relatively smaller ventilating pane and the two panes are actuated by a common drive effecting, relative to movement of the viewing pane, advance motion of the ventilating pane during opening and delayed motion thereof during closing, the apparatus including an actuating device having a slotted guide tube with a flexible threaded cable slidably guided in the tube in a tension and compression transmitting relationship, with the cable being positively connected through the guide tube slot to the larger viewing pane in an arrangement whereby lost motion retains the viewing pane in its closed position during the initial sliding opening action of the ventilating pane, and means adapted to automatically couple the ventilating pane to the drive cable only for and during its opening and closing action.

9 Claims, 8 Drawing Figures

WINDOW WINDING APPARATUS FOR VERTICALLY DIVIDED AUTOMOBILE SLIDING WINDOW PANES

BACKGROUND OF THE INVENTION

This invention relates generally to window winding apparatus for use in vehicles such as automobiles or the like, and specifically pertains to window winding apparatus for achieving a sliding upwardly-downwardly opening and closing action of two adjacent window panes by a common drive wherein one pane is a relatively small ventilating window and the other pane is a larger viewing window, and the ventilating window is adapted to be moved first during the opening operation and to lag behind the movement of the viewing window during closing.

The provision of a slidable ventilating window instead of the more conventional front, generally triangular, window which is adapted to swing on a generally vertical axis, enables effective ventilation of a vehicle interior in modern vehicle body shapes having steeply sloping windshields wherein triangular swingout windows are not generally compatible with the overall body design.

The provision of a slidable ventilating window results in adjacent slidable panes which may be considered as a window subdivided along a generally vertical line. This general arrangement is already known in the prior art in various forms. Known apparatus for actuating and controlling the sliding action of the panes in such an arrangement provide the advantage of actuating both the ventilating pane and a viewing pane quite conveniently by means of a single control system. Usually, a sequence of motion is provided which enables an initial advancement opening motion of the ventilating window while the viewing window remains initially stationary before commencing its own opening sliding motion. By contrast, in actuating the panes to close, the viewing window is slid closed first before the ventilating window is actuated to slide toward its closed position. By virtue of this operational arrangement, depending upon the direction of operation of the window winding apparatus, it is possible to adjust the ventilating pane to provide a ventilating gap without moving the viewing pane, or, upon closure of the viewing pane, the operation of the winding mechanism can be halted at the proper time to leave the ventilating pane in a position which establishes a ventilating gap.

Known apparatus or mechanisms for accomplishing the afore-described window winding sequence are structurally complicated, requiring a significantly large number of parts, some of which are of very complicated shape. In one such window winding mechanism, disclosed in German Pat. No. 2,139,086, two hinge-connected drive arms are provided, each of which is associated with one of the two slidable panes. The drive arms are connected to a number of drive members, such as guide rods, control rods, guide bars, articulations and bolting elements. The manufacture and assembly of this complicated apparatus is therefore correspondingly expensive. Other known window winding mechanisms of the type theretofore discussed are disclosed in German Offenlegungsschriften Nos. 2,241,931; 2,253,021; 2,405,881; 2,405,550; 2,419,343 and U.S. Pat. Nos. 3,782,037 and 3,816,961. The winding mechanisms disclosed in these patents are all of a construction commonly known in the art as arm lifters and are believed to share the characteristics of a complicated and expensive construction.

The present invention comprehends the provision of a window winding apparatus of the general type discussed heretofore but wherein the desired sequence of movement is obtained in a functionally reliable matter with comparatively structurally simplified means.

SUMMARY OF THE INVENTION

The apparatus of this invention comprises an actuating device, patterned after a known general type which includes a longitudinally slotted guide tube, a flexible threaded cable slidably guided in the tube, and a drive device engaging the threaded cable. The apparatus also includes two spaced apart driver elements which extend through the guide tube slot from the threaded cable. One of the driver elements is permanently engaged with the major or viewing window pane, and the other driver element is adapted to be automatically coupled to the minor or ventilation window only for the during its opening and closure strokes or actions. The apparatus is adapted to operate whereby the viewing window is held initially in a stationary position while the ventilating window is slidably retracted.

The window winding apparatus of the present invention is adapted to be suitable both for drive by means of a hand crank or an electric motor. Positive engagement between the drive means and the threaded cable can be effected either through a complimentary pinion or by means of a stationary threaded nut, screwed on to the threaded cable and driven rotationally. The window winding apparatus according to this invention can, because of its relatively simplified construction, comprising only a few parts, be easily assembled and installed in the window storage compartment of an automobile. The apparatus is suitable not only for mounting for operation as a vehicle front door component but can basically be used anywhere it is considered desirable to accomplish the disclosed movement sequence of the adjacent panes of a two pane window assembly. It is therefore contemplated that the disclosed invention can be adapted for use as a rear door vehicle component or in a location where the window storage compartment is integral to the vehicle body.

In the presently preferred form of the apparatus of this invention, provision is made that the guide tube has as many as five separately identifiable portions lying in different planes relative to each other. In the area of movement of the viewing pane of the window assembly, the first portion of the guide tube is disposed substantially vertically and has at its upper end a transition curving into a second guide tube portion disposed parallel to the lower edge of the viewing pane. The second portion extends to a downwardly orientated driving section which merges with a direction-reversing transitional fourth portion leading to a fifth portion which extends vertically upwardly in the area immediately adjacent the ventilating pane.

A lifting bar having a longitudinal slit extends parallel to the lower edge of both the ventilating and viewing panes and is attached in position on the respective pane along the lower edge thereof. The guide slit of the lifting bar attached to the ventilating pane is open at one end, and drivers attached to the threaded cable are equipped with guide members for slidably engaging into the guide slits. The distance between the spaced apart drivers is so arranged in accordance with the guide tube pattern that the guide member associated with the guide slit in the lifting bar of the viewing pane moves, on the guide tube section or portion extending parallel to the lower edge of the viewing pane, through a lost motion equal to a preselected length of travel of the advance retraction or opening motion of the ventilating pane, and that the guide member associated with the lifting bar of the ventilating pane emerges from its associated guide slit at the end of the opening motion of the ventilating pane and reenters it at the commencement of the closing motion of the ventilating pane.

In order that the guide member of the driver associated with the ventilating pane can automatically couple with the uncouple from the ventilating pane, it is provided that the guide tube, in the area of the ventilating pane, be offset for a portion of its length (inclined and/or curved) from the direction of travel of the ventilating pane by an amount proportional to the length of the guide slit in the lifting bar of the ventilating pane. In this manner, a limited transverse movement of the guide member in the assoicated guide slit is assured.

The upper guide edge of the guide slit in the lifting bar of the ventilating pane is longer than the lower guide edge so that the guide member, during coupling, is introduced directly into the guide slit.

A burglar proof provision may be afforded if, in the area of the ventilating pane, the upper end of the guide tube is bent to one side. The driver element, just before the ventilating pane closes, then travels into the laterally bent end of the guide tube, with the result that displacement forces which act upon the ventilating pane from outside cannot produce any downward movement of this pane. The closed viewing pane is correspondingly resistant to unauthorized entry therepast because here the associated guide member or the associated driver element is situated in the guide tube portion extending parallel to the lower edge of the viewing pane.

The guide member for the guide slit in the lifting bar of the ventilating pane may favorably be a roller rotatably mounted upon the driver, while the guide member for the guide slit in the lifting bar for the viewing pane may favorably be constructed as a sliding block. The window winding apparatus of this invention may be either so constructed that the lifting range for the ventilating pane is conducted over the entire pane height to obtain complete lowering of this pane or, alternatively, it is possible for the lifting range of the ventilating pane to be conducted only over a portion of the plane height, to produce only a ventilating gap. An abutment may be provided at the lower end of the lifting range of the ventilating pane to serve as travel limiting means.

BRIEF DESCRIPTION OF THE DRAWINGS

Specific features and advantages of the apparatus of this invention are explained in the ensuing detailed description in reference to the accompanying drawings wherein.

DETAILED DESCRIPTION OF THE PREFERRED EMBODIMENTS

Figure 1:
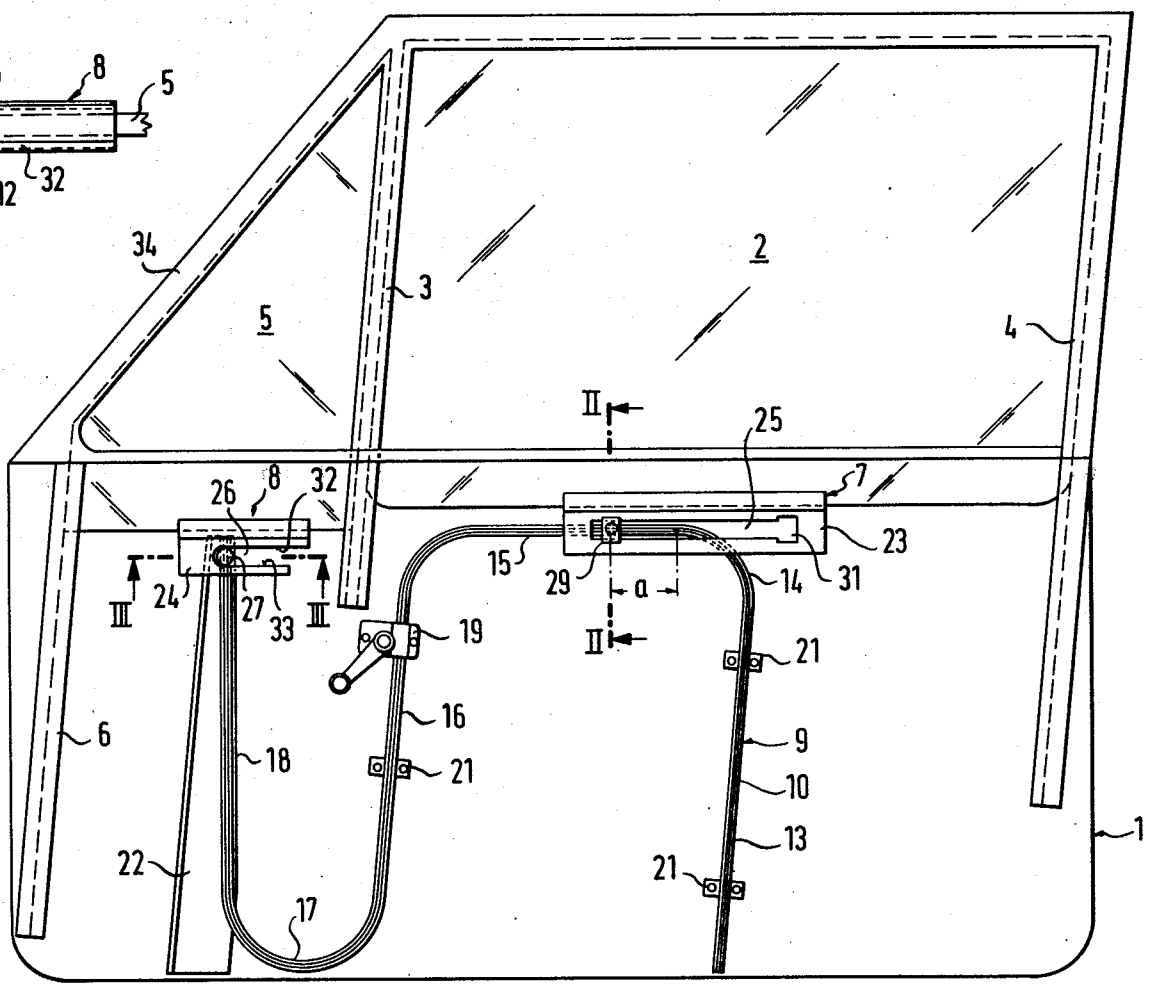
FIG. 1 is an internal view of a window storage compartment of a vehicle door equipped with a window winding apparatus in accordance with this invention, with certain portions of the door structure cut away or not shown for the purpose of clarity.

Referring now to the drawings, window winding apparatus in accordance with this invention is shown in FIG. 1 installed in a vehicle door 1. A viewing pane 2 is guided vertically slidably on lateral frame bars 3 and 4. The frame bar 3 serves also as a guide for the rear longer edge of a likewise vertically slidable ventilating pane 5, the forward short edge which is additionally guided on a guide bar 6 secured to the door 1. To the lower edges of the viewing pane and ventilating pane 5 lifting bars 7 and 8, shown in FIG. 2 in cross section, are attached. Further reference is made hereafter to the construction of the lifting bars 7 and 8.

Figure 3:
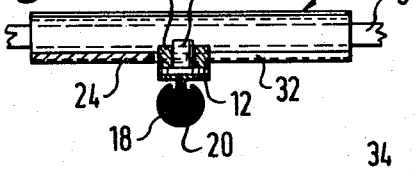
FIG. 3 is a sectional view taken along lines III—III of FIG. 1 and shown in comparatively larger scale than FIG. 1.
Figure 2:
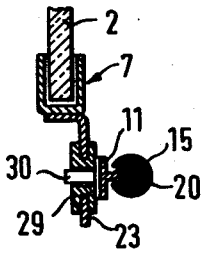
FIG. 2 is a sectional view taken on lines II—II of FIG. 1 and shown in comparatively larger scale than FIG. 1.

An S-shaped guide tube 9 is disposed in the window storage compartment of the door 1 and is provided over its entire length with a longitudinal guide slot 10 through which extends driving elements or drivers 11 and 12, shown in cross section in FIGS. 2 and 3. The guide tube 9 includes a straight portion 13 and a curved transition portion 14 which together serve as a track means for accomplishing the lifting and retraction of the viewing pane 2. The guide tube 9 further includes a portion 15 extending generally parallel to the lower edge of the viewing pane 2 and a drive portion 16 extending from the portion 15 to a direction reversing portion 17, shown in FIG. 1 in an arcuate shape, and a straight portion 18 which acts with the curved portion 17 as a track for the lifting and retracting of the ventilating pane 5.

A drive housing 19, equipped with a hand crank, is disposed on the drive portion 16 of the guide tube 9. By means of this hand crank and of a drive pinion (not shown) the threaded cable 20 is driveably longitudinally displaced within the guide tube 9 in the manner of a toothed rack. The threaded cable, for this purpose, is equipped with a helical thread (not shown) and is guided in the guide tube 9 in a tension and compression transmitting relationship. The drivers 11 and 12 are secured to the threaded cable 20 whereby they move with it and transmit to the panes 2 and 5 the desired adjustment motion as explained in more detail hereafter. The drive system concept theretofore discussed is disclosed in the prior art, for example in German Offenlequnsschrift No. 1,198,239, and therefor does not need further detailed explanation herein.

The guide tube 9 and thereby the entire window winding apparatus is adjustably mounted in position on the vehicle door inner plate (not shown) by means of lugs 21 secured to the guide tube and also by the drive housing 19 and by an angle plate 22 attached to the portion 18 of the quide tube 9.

With reference to the lifting bars 7 and 8 shown in FIG. 1, it will be noted that lifting strips 23 and 24 are respectively attached thereto, and it is these lifting strips 23 and 24 in which respective guide slits 25 and 26 are provided. FIG. 1 also shown that the guide slit 26 is open towards the lifting bar 7. A guide member, constructed as a roller 27, is rotatably journalled on a driver pin 28 and engages in a drive slit 26. The driver pin 28 is also secured to the threaded cable 20 by means of the driver element 12. It would also be possible to modify the arrangement whereby instead of the roller 27, a cylindrical sliding component would be non-rotatably mounted for sliding action relative to the guide slit 26.

A second guide member is disposed for operation in the guide slit 25 and in this embodiment is a sliding block 29 which, as shown in FIG. 2, is rotatably mounted on a driver pin 30 attached to the driver element 11. Both the roller 27 and the sliding block 29 can of course be secured to prevent axial displacement relative to their associated driver pins. The rotatable mounting of the sliding block 29 upon the driver pin 30 is necessary because the driver pin 30, as the driver element 11 travels into the curved transition 14 of the guide tube 9, rotates in the sliding block 29. The sliding block 29 is generally of an H-shape in cross section so that it is guided on both sides of the guide slit 25 along the lifting strip 23. The driver pin 30 is securely attached as shown to the threaded cable 20. To make possible the introduction of the sliding block 29 to the guide slit 25, the slit is widened out at one end, designated as 31, to suit the external dimensions of the sliding block. To enable the entry and exit of the roller 27 in the guide slit 26, an upper guiding edge 32 is constructed longer than the oppositely disposed lower guiding edge 33, as shown in FIG. 1.

Figure 4:
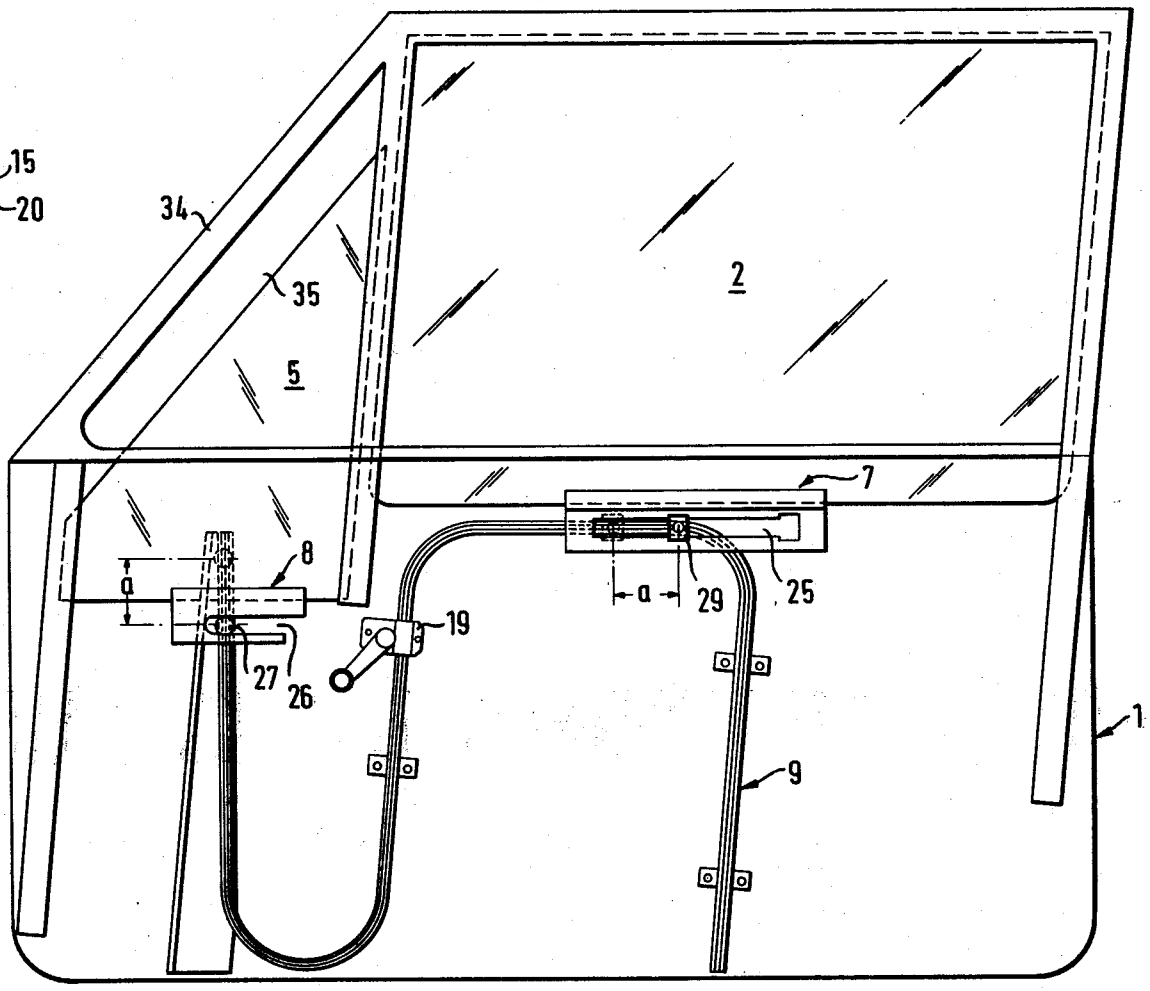
FIG. 4 is an internal elevational view similar to FIG. 1, showing the disposition of parts of the apparatus of the present invention wherein the ventilating pane of the window assembly is partially open and the viewing pane is closed.
Figure 5:
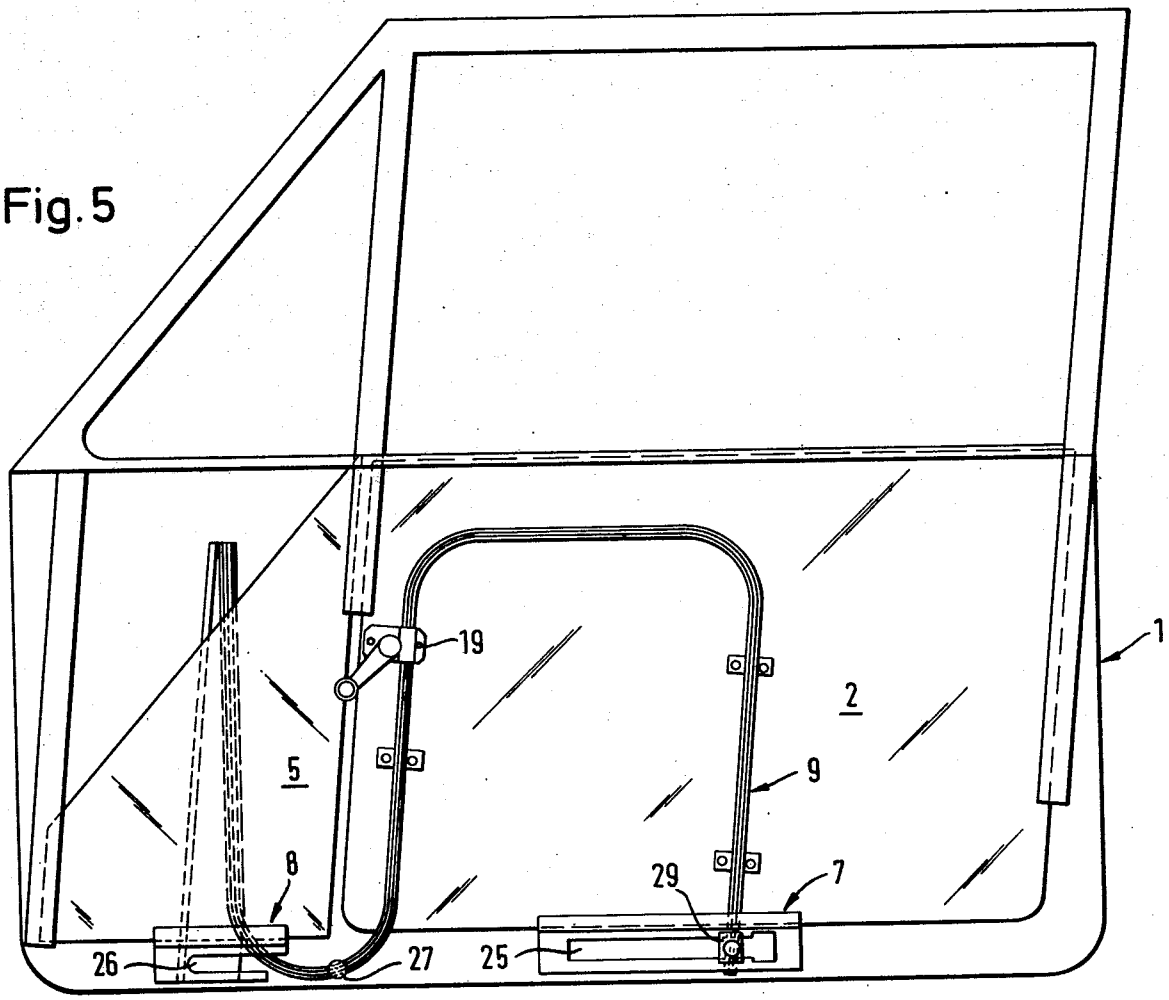
FIG. 5 is a view similar to FIGS. 1 and 4 wherein both panes of the window assembly are open.

The movement sequence attainable by means of the window winding apparatus of this invention may be best understood by reference to FIGS. 1, 4 and 5. If FIG. 1 the viewing pane 2 and the ventilating pane 5 are situated in their upper closed position. Starting from this position, the crank of the drive housing 19 is manually rotated counterclockwise in the direction of an opening actuation, thus causing the roller 27 to move downwards as the sliding block 29 simultaneously move to the right. As can be seen from the drawing, the motion of the roller 27 leads to immediate entrainment of the ventilating pane 5, because the roller 27 bears against the lower guide edge 33 of the guide slit 26. By contrast, the sliding block 29 initially moves parallel to the lower edge of the viewing pane 2 in the guide slit 25 in a lost motion operation whereby the viewing pane 2 still remains closed. The result of this is that the advanced motion of the ventilating pane 5, which only terminates when the sliding block 29 has travelled the distance a and then moved downwards by entry of the driver 11 into the curved transition 14 of the guide tube 9. From that point on, both the ventilating pane 5 and also the viewing pane 2 are in slidable motion. It is also possible for the actuation of the crank of the drive housing 19 to be interrupted at an earlier instant so that the viewing pane 2 remains closed whereas a ventilating gap 35 appears between a frame bar 34 of the door 1 and the ventilating pane 5. This ventilating gap 35 can be infinitely adjusted in its width by suitable actuation of the crank of the driver housing 19.

FIG. 4 illustrates the position of the ventilating pane 5 and the viewing pane 2 at the commencement of the opening sliding displacement of the viewing pane 2. Following this action, the two panes 5 and 2 move downward in unison because the roller 27 is still in engagement with the guide slit 26 and because the sliding block 29 entrains the viewing pane 2 downwards by means fo the lifting strip 23, assisted of course by the weight of viewing pane 2. The speed of movement of the ventilating pane 5 is initially greater than that of the viewing pane 2 because the sliding block 29 initially still moves in a curve on the curved transition 14 of the guide tube 9. After the curved transition 14 has been traversed, the two panes 2 and 5 then move with approximately the same speed, this on the assumption that the portions 13 and 18 of the guide tube 9 are inclined at the same angle relative to the vertical.

When the ventilating pane 5 has arrived at its lower limiting position, the roller 27 emerges from the guide slit 26 and is freely moved onwards by the driven threaded cable 20. Thereafter in the movement sequence, only the viewing pane 2 continues to slide downwardly until it adopts its fully open position shown in FIG. 5.

In the closure movement or operation, the hand crank of the drive housing 19 is rotated clockwise, thus causing the slide block 29 to move upward, and immediately to entrain the viewing window 2. The viewing pane 2 initially moves in its closure direction alone until the roller 27, by abutting against the upper guide edge 32 of the guide slit 26, automatically becomes coupled to the ventilating pane 5. From then on, the two panes 2 and 5 again move upward together whereby the viewing pane 2 first reaches its closed position, with the ventilating pane 5, starting from the position shown in FIG. 4, following afterwards with continuous reduction of the ventilating gap 35 until this pane is also finally again situated in its closed position as shown in FIG. 1. During the later motion of the ventilating pane 5, the sliding block 29 moves parallel to the lower edge of the viewing pane 2 in its guide slit 25 in a lost motion operation which has no movement effect on the pane 2.

Figure 6:
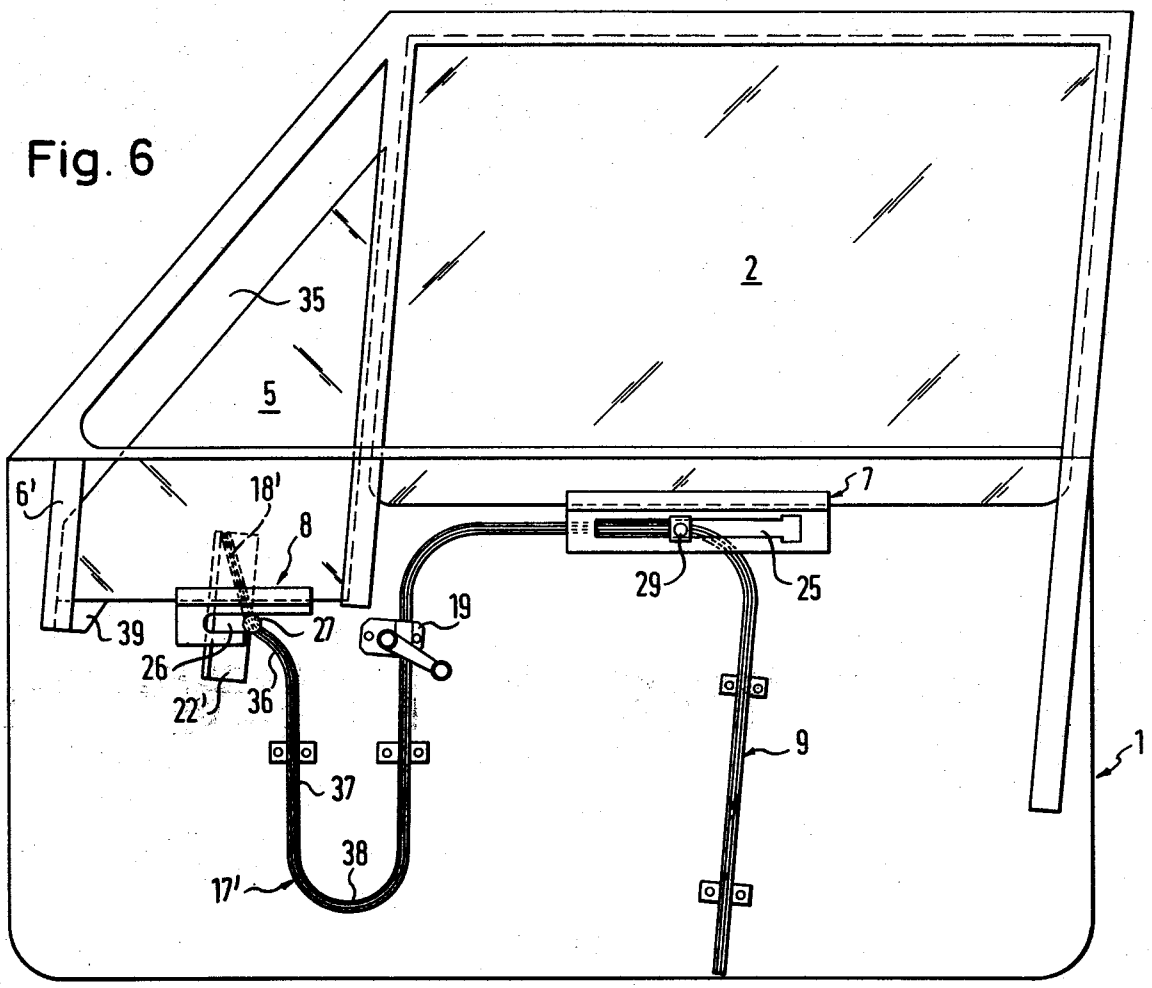
FIG. 6 is an inside view of a vehicle door similar to FIGS. 1, 4 and 5, but illustrating another embodiment of the window winding apparatus in accordance with this invention.

In order that the roller 27 can emerge from the guide slit 26 and enter the guide slit 26, the straight portion 18 of the guide tube 9 should, as can be seen from FIG. 1, be inclined relative to the direction of motion of the ventilating pane 5 as determined by the frame bar 3 and guide bar 6. If the travel of the ventilating pane 5 is designed to be considerably smaller than that of the viewing pane 2, then this inclination must be considerable in order that the roller 27 can travel an appreciable transverse distance for only a relatively short distance of travel. As an example of an embodiment with a short stroke for the ventilating pane 5 reference should be made to FIG. 6. Here the straight portion 18' of the guide tube 9 is adapted to the reduced distance of stroke by suitable shortening whereby the direction-reversing portion 17' of the guide tube is shaped with an arc 36 adjoining the straight portion 18', and also with a straight portion 37 and an additional arc 38. In this embodiment, the guide bar 6′ and angle plate 22′ are of course also contructed relatively shorter. The lower open position of the ventilating pane 5 is marked by the travel-limiting abutment 39, mounted on the guide bar6′. The movement sequence of the two panes 2 and 5 takes place in both directions of actuation in a manner analogous to that which was described with reference to FIGS. 1, 4 and 5. However, in this embodiment the ventilating pane 5 cannot be fully lowered so the position of the ventilating pane illustrated also illustrates the maximum achievable width of the ventilating gap 35.

Figure 7:
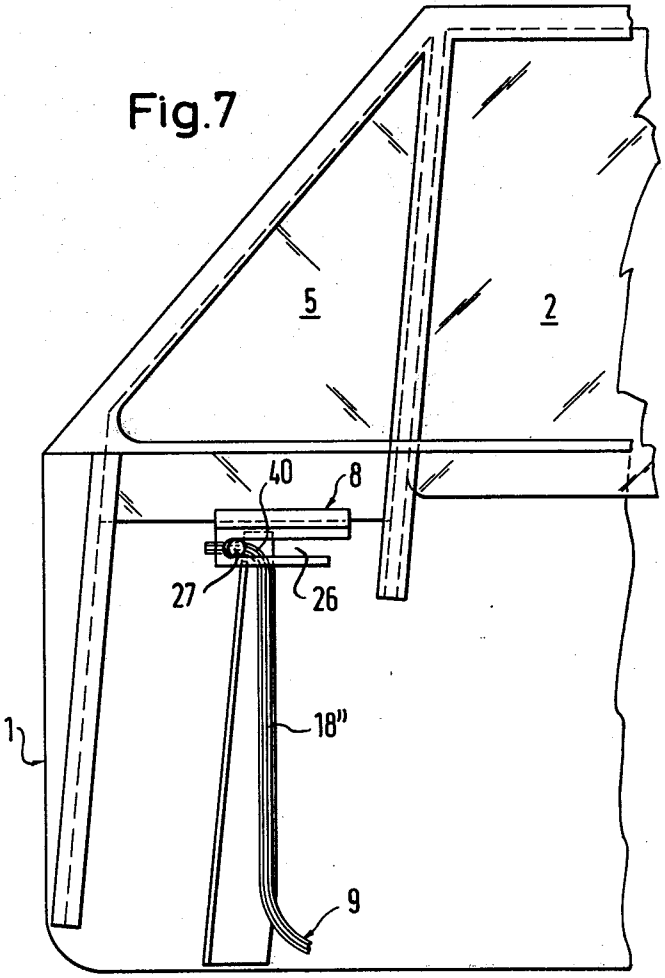
FIG. 7 is a partial inside view of a vehicle door showing window winding apparatus wherein the guide tube thereof, in the area of the ventilating pane, is curved at its upper end to one side in accordance with a modified form of the present invention.

In the window winding apparatus embodiment shown in FIG. 7, an upper end 40 of the straight portion 18″ of the guide tube 9 is bent to one side so that the driver 12, in the last phase of the closure motion of the ventilating pane 5, enters the curved upper end 40, and the roller 27, in addition to its upward motion undergoes a transverse motion towards the left. After complete closure of the ventilating pane 5, the roller 27 can still move towards the left for a limited distance parallel to the lower edge of the ventilating pane 5. Conversely, the roller 27 must move toward the right transversely by this limited amount, when the ventilating pane is to be opened, before the roller 27, with continuous transverse movement, also moves downwardly in the arc of the guide tube end 40 and thereby entrains the ventilating pane 5 downwardly. This embodiment has the advantage that the ventilating pane 5, in the position shown in FIG. 7, cannot be displaced downward by externally applied force whereby the ventilating pane 5 offers the same security against unauthorized entry to the vehicle as that of the viewing pane 2.

Figure 8:
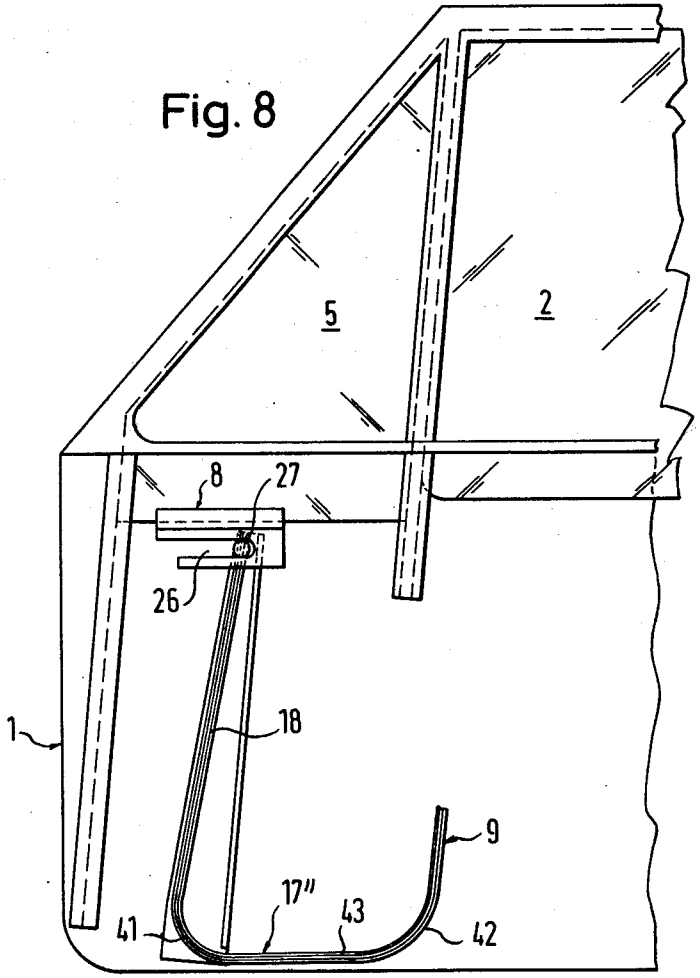
FIG. 8 is a partial inside view of a vehicle door similar to FIG. 7, wherein the window winding apparatus components disclosed in the area of the ventilating pane are illustrated in accordance with still another contemplated modification of the window winding apparatus of this invention.

As can be seen with reference to FIG. 8, it is not absolutely essential for the guide slit 26 to be opened toward the lifting bar 7. Its opening may also face in the opposite direction, for which purpose it is only necessary for the direction-reversing portion 17″ to be constructed, as shown in the drawing, of two arc-shaped portions 41 and 42 and of a straight portion 43. The inclination of the straight portion 18 of the guide tube 9 in FIG. 8 differs from the arrangement shown in FIG. 1 by its opposite inclination to a vertical axis of symmetry.

It is anticipated that those skilled in the art, by benefit of this disclosure, may then contemplate modifications or changes of the disclosed apparatus. It is intended that the appended claims will cover all such modifications or changes as come within the true spirt and scope of the invention.

We claim:

1. Winding apparatus for a window assembly of a vehicle such as an automobile or the like wherein the assembly includes a window which is slidable generally upwardly-downwardly in an opening and closing action and the window assembly includes a relatively small ventilating pane and a larger viewing pane actuated by a common drive adapted to produce advance motion of the ventilating pane during opening and delayed motion of the ventilating pane during closing, comprising a longitudinally slotted elongated guide tube with a flexible threaded cable guided slidably in the tube in a tension and compression transmitting relationship, two spaced apart drivers extending through the guide tube slot and secured to the threaded cable, one of the drivers being in continuous engagement with the viewing pane and adapted to undergo a lost motion which retains the viewing pane in its closed position during opening advancement of the ventilating pane, and the other of the drivers being adapted to automatically couple to the ventilating pane only for and during its opening and closing motion.

2. Window winding apparatus according to claim 1 wherein a first portion of the guide tube is disposed, adjacent the viewing pane, substantially perpendicularly, and has an arcuate transition at its upper end extending into a second guide tube portion disposed generally parallel to the lower edge of the viewing pane, downwardly oriented third guide tube portion ajoining the second guide tube portion and leading to a direction-reversing transitional fourth guide tube portion, a fifth guide tube portion extending upwardly from the transitional fourth guide tube portion, a lifting bar attached to the lower edge of each of the panes and having a guide slit extending generally parallel to such edge, the guide slit of the lifting bar attached to the ventilating pane being open at one end, the drivers attached to the threaded cable being equipped with guide members slidably engaging into each of guide slits and the distance between them being so arranged and adapted to the guide tube pattern that the guide member associated with the guide slit in the lifting bar of the viewing pane moves, within the guide tube portion extending parallel to the lower edge of the viewing pane, through a lost motion corresponding to advance opening movement of the ventilating pane, and the guide member associated with the lifting bar of the ventilating pane emerges from its associated guide slit at the end of the opening movement of the ventilating pane and enters it at the commencement of the closing movement thereof.

3. Window winding apparatus according to claim 1 wherein a portion of the guide tube adjacent the ventilating pane is offset for a portion of its length with respect to the direction of motion of the ventilating pane in order to be operatively compatible with the length of the guide slit in the lifting bar of the ventilating pane.

4. Window winding apparatus according to claim 1 wherein the upper edge of the guide slit in the lifting bar of the ventilating pane is constructed longer than the lower edge.

5. Window winding apparatus according to claim 1 wherein the guide tube, in the area adjacent the ventilating pane, is bent to one side.

6. Window winding apparatus according to claim 1 wherein the guide member of the guide slit in the lifting bar of the ventilating pane is a roller mounted upon one of the drivers, and the guide member for the guide slit in the lifting bar of the viewing pane is constructed as a sliding block.

7. Window winding apparatus according to claim 1 wherein the apparatus is adapted to move the ventilating pane a distance comparable to the height of the pane to assure complete lowering of the ventilating pane.

8. Window winding apparatus according to claim 1 wherein the apparatus is adapted to lift the ventilating pane only a part of the height of the ventilating pane to establish a ventilating gap.

9. Window winding apparatus according to claim 8 wherein a travel-limiting abutment is provided at the lower end of the ventilating pane.

* * * * *

UNITED STATES PATENT AND TRADEMARK OFFICE

CERTIFICATE OF CORRECTION

PATENT NO. : 4,020,593
DATED : May 3, 1977
INVENTOR(S) : Horst Salomon and Herbert Kouth It is certified that error appears in the above-identified patent and that said Letters Patent are hereby corrected as shown below:

Column 1, Line 63, after "type" delete 'theretofore' and insert --heretofore--.
Column 2, Line 20, after "for" delete 'the' and insert --and--.
Column 3, Line 13, after "with" delete 'the' and insert --and--.
Column 4, Line 67, after "concept" delete 'theretofore' and insert --heretofore--.
Column 5, Line 8, after "the" delete 'quide' and insert --guide--.
Column 5, Line 13, after "also" delete 'shown' and insert --shows--.
Column 5, Line 47, after "5" delete 'If' and insert --In--.
Column 6, Line 15, after "means" delete 'fo' and insert --of--.
Column 8, Line 12, after "pane," insert --a--.
Column 8, Line 50, after "member" delete 'of' and insert --for--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*